US010238941B2

(12) United States Patent
Ianni et al.

(10) Patent No.: US 10,238,941 B2
(45) Date of Patent: Mar. 26, 2019

(54) BASKETBALL NET WHICH DETECTS SHOTS THAT HAVE BEEN MADE SUCCESSFULLY

(71) Applicant: ShotTracker, Inc., Mission Hills, KS (US)

(72) Inventors: Bruce C. Ianni, Mission Hills, KS (US); Davyeon D. Ross, Overland Park, KS (US); Clint A. Kahler, Overland Park, KS (US); Thomas James Keeley, Kansas City, MO (US); Harold K. Hoffman, Jr., Overland Park, KS (US); Roger Allan Gruenke, Shawnee, KS (US); Patrick M. Herron, Austin, TX (US)

(73) Assignee: SHOTTRACKER, INC., Merriam, KS (US)

( * ) Notice: Subject to any disclaimer, the term of this patent is extended or adjusted under 35 U.S.C. 154(b) by 656 days.

(21) Appl. No.: 14/876,440

(22) Filed: Oct. 6, 2015

(65) Prior Publication Data

US 2016/0096067 A1 Apr. 7, 2016

Related U.S. Application Data

(60) Provisional application No. 62/060,692, filed on Oct. 7, 2014, provisional application No. 62/060,694, filed on Oct. 7, 2014.

(51) Int. Cl.
*A63B 69/00* (2006.01)
*A63B 63/08* (2006.01)

(52) U.S. Cl.
CPC ..... *A63B 69/0071* (2013.01); *A63B 63/083* (2013.01); *A63B 2209/02* (2013.01);
(Continued)

(58) Field of Classification Search
USPC ..... 473/480
See application file for complete search history.

(56) References Cited

U.S. PATENT DOCUMENTS 4,438,588 A 3/1984 Martin
5,316,293 A 5/1994 Hamilton
(Continued)

FOREIGN PATENT DOCUMENTS

EP 1232772 A3 6/2003
EP 2472288 A1 7/2012
(Continued)

OTHER PUBLICATIONS http://swishmetrics.com/, Sep. 2014.
(Continued)

*Primary Examiner* — Masud Ahmed
(74) *Attorney, Agent, or Firm* — Grady L. White; Potomac Law Group, PLLC

(57) ABSTRACT

A made-shot-detecting net system is configured to determine when a basketball passes through the net. The system uses a strand of conductive material that is laced through the net, an electrical property (e.g., resistance) of which changes (e.g., increases) as the net—and hence the strand of conductive material—is stretched. By filtering out steady-state components of a voltage signal obtained from the net, instances where the net is being stretched can be identified. A value obtained by integrating (i.e., summing) the voltage output over the course of a stretch event is compared to various thresholds to identify the nature of the event. In certain embodiments, the fact that a shot has been made is transmitted wirelessly to a basketball-performance tracking application running on a mobile electronic computing device.

17 Claims, 9 Drawing Sheets

(52) U.S. Cl.
CPC ... *A63B 2220/801* (2013.01); *A63B 2220/833* (2013.01); *A63B 2225/50* (2013.01)

(56) References Cited

U.S. PATENT DOCUMENTS

| | | | | |
|---|---|---|---|---|
| 5,526,326 | A | 6/1996 | Fekete et al. | |
| 5,697,791 | A | 12/1997 | Nashner et al. | |
| 5,776,018 | A | 7/1998 | Simpson et al. | |
| 6,157,898 | A | 12/2000 | Marinelli | |
| 6,280,352 | B1 | 8/2001 | Coffeen et al. | |
| 6,389,368 | B1 | 5/2002 | Hampton | |
| 6,418,179 | B1 | 7/2002 | Shieh | |
| 6,620,057 | B1 | 9/2003 | Pirritano et al. | |
| 7,091,863 | B2 | 8/2006 | Ravet | |
| 7,095,312 | B2 | 8/2006 | Erario et al. | |
| 7,182,704 | B2 | 2/2007 | Levy | |
| 7,625,314 | B2 | 12/2009 | Ungari et al. | |
| 7,771,320 | B2 | 8/2010 | Riley et al. | |
| 7,854,669 | B2 | 12/2010 | Marty et al. | |
| 7,949,295 | B2 | 5/2011 | Kumar et al. | |
| 8,079,925 | B2 | 12/2011 | Englert et al. | |
| 8,099,258 | B2 | 1/2012 | Alten et al. | |
| 8,231,487 | B2 | 7/2012 | Nurnberg et al. | |
| 8,249,254 | B1 | 8/2012 | Daniel | |
| 8,360,904 | B2 | 1/2013 | Oleson et al. | |
| 8,517,869 | B2 | 8/2013 | Steidle | |
| 8,540,560 | B2 | 9/2013 | Crowley et al. | |
| 8,579,632 | B2 | 11/2013 | Crowley | |
| 8,597,095 | B2 | 12/2013 | Crowley et al. | |
| 8,622,832 | B2 | 1/2014 | Marty et al. | |
| 8,702,430 | B2 | 4/2014 | Debenedetto et al. | |
| 8,777,815 | B2 | 7/2014 | Case et al. | |
| 8,786,415 | B2 | 7/2014 | Cavallaro et al. | |
| 8,951,106 | B2 | 2/2015 | Crowley et al. | |
| 9,308,417 | B2 | 4/2016 | Grundy | |
| 2003/0054905 | A1 | 3/2003 | King | |
| 2004/0145342 | A1 | 7/2004 | Lyon | |
| 2005/0223799 | A1 | 10/2005 | Murphy | |
| 2005/0261609 | A1 | 11/2005 | Collings et al. | |
| 2006/0105857 | A1 | 5/2006 | Stark | |
| 2007/0135243 | A1 | 6/2007 | Larue | |
| 2007/0173355 | A1 | 7/2007 | Klein | |
| 2007/0219024 | A1 | 9/2007 | Allegre | |
| 2008/0015061 | A1* | 1/2008 | Klein | A63B 69/0071 473/447 |
| 2008/0088303 | A1 | 4/2008 | Englert | |
| 2008/0274844 | A1 | 11/2008 | Ward | |
| 2009/0048070 | A1 | 2/2009 | Vincent et al. | |
| 2009/0111616 | A1 | 4/2009 | Creelman | |
| 2009/0117525 | A1 | 5/2009 | Bavaro et al. | |
| 2009/0191988 | A1* | 7/2009 | Klein | A63B 24/0021 473/480 |
| 2012/0316843 | A1 | 12/2012 | Beno et al. | |
| 2012/0323496 | A1 | 12/2012 | Burroughs et al. | |
| 2013/0167290 | A1 | 7/2013 | Ezra | |
| 2013/0172131 | A1* | 7/2013 | Bove, Jr. | A63B 63/083 473/480 |
| 2014/0039651 | A1 | 2/2014 | Crowley et al. | |
| 2014/0135150 | A1 | 5/2014 | Thurman et al. | |
| 2014/0135956 | A1 | 5/2014 | Thurman et al. | |
| 2014/0135957 | A1 | 5/2014 | Thurman et al. | |
| 2014/0135958 | A1 | 5/2014 | Thurman et al. | |
| 2014/0135959 | A1 | 5/2014 | Thurman et al. | |
| 2014/0195019 | A1 | 7/2014 | Thurman et al. | |
| 2014/0195020 | A1 | 7/2014 | Thurman et al. | |
| 2014/0195021 | A1 | 7/2014 | Thurman et al. | |
| 2014/0195022 | A1* | 7/2014 | Thurman | G09B 19/0038 700/91 |
| 2014/0200103 | A1 | 7/2014 | Thurman et al. | |
| 2014/0200692 | A1 | 7/2014 | Thurman et al. | |
| 2014/0222177 | A1* | 8/2014 | Thurman | G09B 19/0038 700/92 |
| 2014/0266759 | A1 | 9/2014 | Pryor et al. | |
| 2014/0274486 | A1 | 9/2014 | Thurman | |
| 2014/0274487 | A1 | 9/2014 | Thurman | |
| 2014/0277634 | A1 | 9/2014 | Thurman | |
| 2014/0277635 | A1 | 9/2014 | Thurman | |
| 2014/0277636 | A1 | 9/2014 | Thurman | |
| 2014/0371885 | A1* | 12/2014 | Ianni | G06K 9/00342 700/91 |
| 2015/0112464 | A1 | 4/2015 | Crowley et al. | |
| 2015/0312493 | A1 | 10/2015 | Aldridge et al. | |
| 2015/0312494 | A1 | 10/2015 | Aldridge et al. | |
| 2015/0312497 | A1 | 10/2015 | Aldridge et al. | |
| 2015/0312504 | A1 | 10/2015 | Aldridge et al. | |
| 2015/0317801 | A1 | 11/2015 | Bentley et al. | |

FOREIGN PATENT DOCUMENTS

| | | | |
|---|---|---|---|
| JP | 2000-061016 | A | 2/2000 |
| WO | 2001-025946 | A1 | 4/2001 |
| WO | 2004-009188 | A1 | 1/2004 |
| WO | 2007-084850 | A2 | 7/2007 |
| WO | 2007-130057 | A1 | 11/2007 |
| WO | 2012-121434 | A1 | 9/2012 |
| WO | 2013-029035 | A1 | 2/2013 |

OTHER PUBLICATIONS http://www.noahbasketball.com/products, Sep. 2014.
http://shop.94fifty.com/, Sep. 2014.
http://www.wilson.com/smart/, Sep. 2014.
http://www.hooptracker.com/, Sep. 2014.
http://shootersrev.com/product/evo-one-sensorized-basketball/, Sep. 2014.
http://www.shootaway.com/, Sep. 2014.
http://www.vibradotech.com/, Sep. 2014.
Introduction about Nintendo WII Software, Nintendo Korea, Jun. 24, 2010.
Beetz et al. "Computerized real-time analysis of football games." Pervasive Computing, IEEE 4.3 (2005): 33-39.
Baca et al. "Rapid feedback systems for elite sports training." Pervasive Computing, IEEE 5.4 (2006): 70-76.
Danner et al. "Description of the Physical Activity of Young Children Using Movement Sensor and Observation Methods." Pediatric Exercise Science. 1991.

* cited by examiner

BASKETBALL NET WHICH DETECTS SHOTS THAT HAVE BEEN MADE SUCCESSFULLY

CROSS-REFERENCE TO RELATED APPLICATIONS

This application is based on and claims the priority benefit of provisional U.S. application No. 62/060,692 filed Oct. 7, 2014.

FIELD OF THE INVENTION

In general, the present disclosure relates to a system for monitoring performance while playing basketball. More particularly, the disclosure features a net that is configured to detect when a basketball passes through it, i.e., when a shot has been made successfully.

BACKGROUND OF THE INVENTION

Applicants' U.S. Pat. No. 9,129,153 discloses a basketball shot-tracking system. According to this patent, a wrist-worn sensor is first "trained" or calibrated to recognize various shots a player might make, such as jump shots, hook shots, layups, etc. Once the wrist-worn sensor has been calibrated, it monitors the motion of the player's wrist and detects when a shot attempt of a given type has been made. When a shot attempt is made, the wrist-worn sensor sends a message wirelessly to a mobile computing device (smartphone, tablet computer, laptop computer, etc.), which runs an associated shot-tracking program.

In a very simple application, the system could be used to do nothing more than count the number of times the player takes a shot of a given type. This might be useful, for example, for practice or training purposes, where a player wishes to take a certain number of shots of each type.

On the other hand, the number of shots taken, per se, is not often particularly useful information. Rather, it is the player's shooting percentage—i.e., the percentage of shots of a given type that are made successfully—that is more important to know. Therefore, the system disclosed in U.S. Pat. No. 9,129,153 also includes a net-mounted sensor configured to detect when shots have been made successfully, and to transmit that information wirelessly to the mobile computing device. More particularly, the net-mounted sensor disclosed in U.S. Pat. No. 9,129,153 detects shots that have been made successfully by matching the time profile of the magnitude of sensor acceleration to a pre-established normative profile for sensor acceleration magnitude exhibited when a shot has been made successfully, where acceleration magnitude is the square root of the sum of the squares of the sensor acceleration along three orthogonal axes that are fixed relative to the sensor.

SUMMARY OF THE INVENTION

The present disclosure features an alternate apparatus and method to detect when a basketball shot has been made successfully. According to the disclosed approach to detecting when a shot has been made successfully, a basketball net includes a conductive element that stretches with the net when a basketball passes through the net, and an electrical property of the element (e.g., its resistance) varies (e.g., increases) as the element stretches. By sensing the electrical parameter of the element and comparing the output over time of an associated circuit to a normative output profile corresponding to a basketball passing through the net, successfully made shots can be detected.

Thus, in a first aspect, the invention features a made-shot-detecting net system configured to detect when a basketball shot is made successfully. The system includes a net, which stretches in at least one direction when a basketball passes through it. The net has a strand of elastomeric conductive material extending along a portion thereof, and the elastomeric material stretches with the net as a basketball passes through the net. As noted above, the strand of elastomeric conductive material has an electrical property that varies as it stretches.

A made-shot-detecting electronics module to which the strand of elastomeric conductive material is connected, or is configured to be connected, has a sensing circuit that makes electrical contact with the strand of conductive material when the strand of conductive material is connected to the made-shot-detecting electronics module, and an electrical output of the circuit varies as the electrical property of the strand of elastomeric conductive material varies. The electronics module further includes a processor and computer program code configured to cause the processor to read a series of values over time of the sensing circuit's electrical output and to compare the series of values over time to a normative profile of the sensing circuit's electrical output over time that corresponds to a basketball passing through the net.

In specific exemplary embodiments, the series of values over time of the sensing circuit's output are digitally integrated to determine a stretch power value, which is then compared to a first, predetermined threshold value that is associated with the normative profile. Suitably, a steady-state baseline value of the sensing circuit's electrical output corresponding to a condition in which the net is not moving is first determined, and digitally integrating the series of values over time entails summing a difference between the value of the sensing circuit's electrical output and the steady-state baseline value. Moreover, the series of values over time of the sensing circuit's electrical output are suitably only integrated for periods of time during which the sensing circuit's electrical output exceeds the baseline value.

The system may also include a wireless transmitter by means of which a message can be sent indicating that a basketball shot has been made successfully when the stretch power value satisfies a predetermined relationship relative to the first, predetermined threshold value. Furthermore, the system may be configured to compare the stretch power value to one or more secondary threshold values associated with net events other than a successful shot being made in the event the stretch power value does not satisfy the predetermined relationship relative to the first, predetermined threshold value, and to send message indicating the occurrence of these other non-successful-shot events.

Regarding the net, suitably, the electrical property of the conductive material that varies as the net stretches is electrical resistance, and the sensing circuit's electrical output that is read may be a voltage. Furthermore, the strand of elastomeric conductive material may extend in a circumferential direction around the net, e.g., at least essentially completely around the net. Further still the strand of elastomeric conductive material may extend around an upper portion of the net and form the loops by means of which the net can be attached to a basketball hoop.

In another aspect, the invention features a system for tracking basketball-shooting performance. The system includes a made-shot-detecting net system as described above, including a wireless transmitter in the electronics module, and a mobile computing device having a shot-tracking computer program thereon. The shot-tracking computer program is configured to receive messages sent from the made-shot-detecting electronics module and to tabulate successfully made shots.

In a still further aspect, the invention features a method for detecting when a basketball passes through a net, where the net includes an electrically conductive element that stretches with the net as the basketball passes through it and an electrical property of the electrically conductive element varies as the element stretches. The method entails sensing the electrical property of the conductive element with a sensing circuit, an output of which varies with the electrical property of the electrically conductive element; and reading a series of values over time of the sensing circuit's electrical output and comparing the series of values over time to a normative profile of the sensing circuit's electrical output over time that corresponds to a basketball passing through the net.

In specific exemplary embodiments, the series of values over time of the sensing circuit's output is digitally integrated to determine a stretch power value, which is then compared to a first, predetermined threshold value that is associated with the normative profile. Suitably, a steady-state baseline value of the sensing circuit's electrical output corresponding to a condition in which the net is not moving is first determined, and digitally integrating the series of values over time of the sensing circuit's electrical output entails summing a difference between the value of the sensing circuit's electrical output and the steady-state baseline value. Furthermore, the series of values over time of the sensing circuit's electrical output are suitably integrated only for periods of time during which the sensing circuit's electrical output exceeds the baseline value.

When a successful shot is detected, a message may be sent wirelessly so indicating if the stretch power value satisfies a predetermined relationship relative to the first, predetermined threshold value. Moreover, the stretch power value may be compared to one or more secondary threshold values associated with net events other than a successful shot being made in the event the stretch power value does not satisfy the predetermined relationship relative to the first, predetermined threshold value, and messages may be sent wirelessly indicating the occurrence of these other non-successful-shot events as they occur.

BRIEF DESCRIPTION OF THE DRAWINGS

These and other features of the invention will become clearer from the detailed description below as well as the drawings, in which.

DETAILED DESCRIPTION OF EMBODIMENTS OF THE INVENTION

Figure 1:
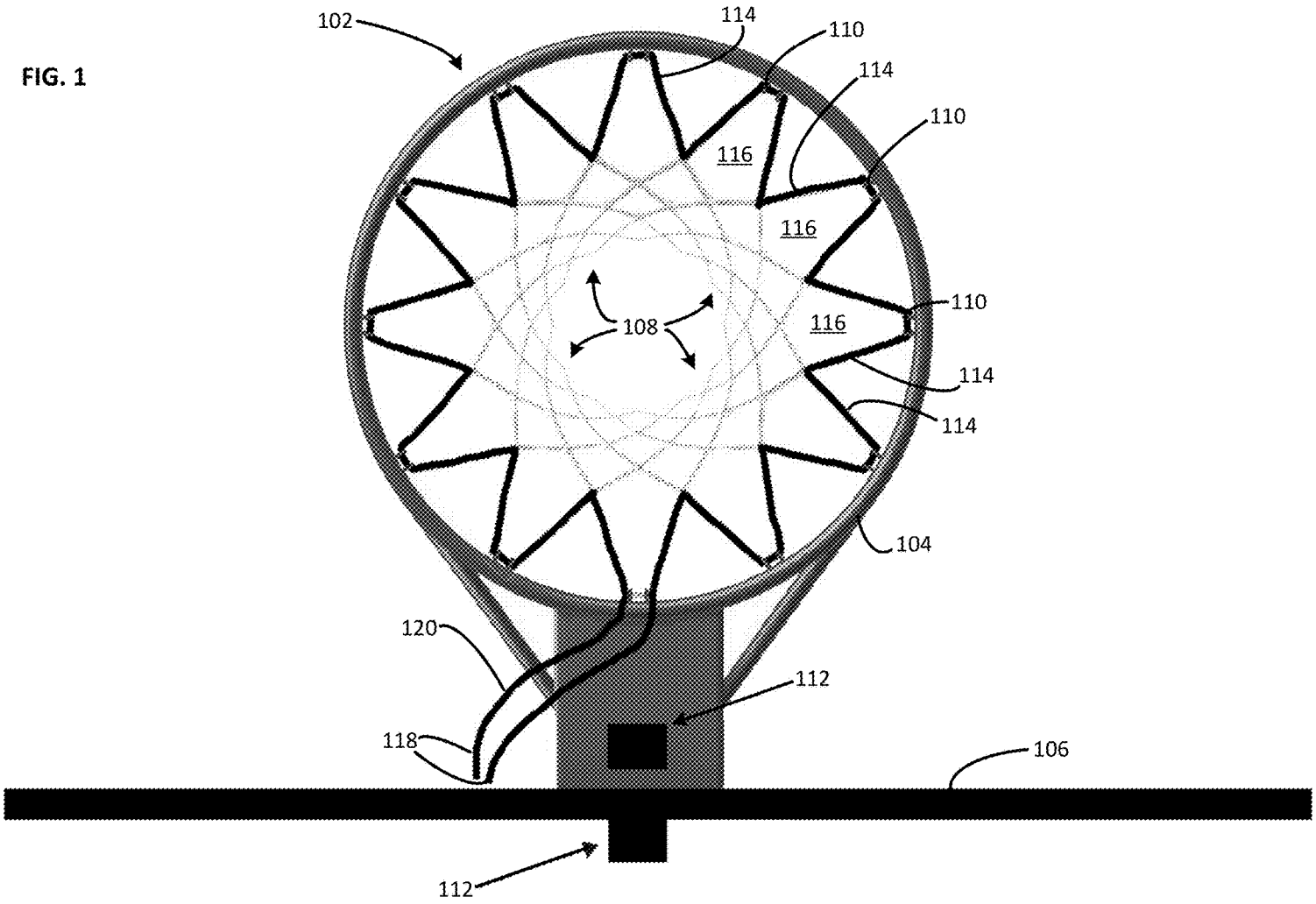
FIG. 1 is a schematic plan view of one embodiment of a basketball net which detects shots that have been made successfully in accordance with the claimed invention.

In this disclosure, the last two digits of each reference numeral identify a given component, element, or algorithm step, and the preceding one or two digits of each reference numeral correspond(s) to the number of the figure in which the element or step is depicted. Thus, if a given element is shown in multiple figures, strictly speaking, the element will have different reference numerals in each of the several figures; however, the last two digits will be the same across all related figures being discussed at the same time in order to explain a particular concept or aspect of embodiments of the invention. For example, the same strand of elastomeric conductive material is depicted in both FIGS. 1 and 2 as element number 114 and 214, respectively. If multiple figures are being addressed at the same time within this disclosure, just the reference numeral used in the lowest-numbered figure will be used in the text. Furthermore, different elements that are illustrated in different figures, which are discussed at different points within this disclosure, may have reference numerals in which the last two digits are the same, the fact that the elements are being discussed at different points in the disclosure should, however, prevent such commonality of the last two reference-numeral digits from causing confusion.

A basketball hoop assembly 102 in accordance with the claimed invention is illustrated in FIG. 1. The hoop assembly 102 includes a conventional hoop structure 104 that is mounted to a conventional backboard 106, and a net 108 in accordance with the invention that is attached to the hoop 104 via a number of eyelets 110 located around the circumference of the hoop 104. A made-shot-detecting electronics module 112, which houses a circuit board with processing circuitry, wireless transmission circuitry, and a battery, may be mounted to the hoop structure 104, e.g., in the rim cavity on the underside of the hoop structure 104 behind the hoop, or on the back of the backboard 106. (Both such mounting locations are shown in the figure; it should be understood, however, that only one made-shot-detecting electronics module 112 would be provided in an actual implementation of the invention.)

Generally speaking, the net 108 suitably has a conventional configuration in that it is formed as a meshwork of individual elements (not individually identified) that form a generally tubular structure, which is open at its top and bottom end. The net 108 suitably is made from typical material such as cotton or a nylon blend, which, combined with the mesh configuration of the net 108, allows the net 108 to stretch in various directions.

Furthermore, in accordance with the invention, the net 108 includes a strand 114 of elastomeric conductive material such as SSM-070 stretch-sensing material, which can be obtained in cord-form from Images SI, Inc. (http://www.imagesco.com/sensors/stretch-sensor.html)—identified by the heavier, dark lines in FIG. 1—laced through and/or along the uppermost elements of the net 108, i.e., the elements of the net that form the diamond-shaped loop portions 116 by means of which the net 108 is attached to the eyelets 110. Suitably, the strand 114 of conductive material extends at least essentially around the entirety of the net 108, if not completely around the entirety of the net. Significantly, the electrical resistance of the material from which the strand 114 is made varies—typically increasing—as it stretches/elongates, which property is utilized according to the invention to detect when a basketball passes through the net 108 as explained in more detail below. Connectors 118 are provided on the free ends of the strand "tails" 120, which connectors 118 allow the strand of conductive material 114 to be electrically connected to an electrical circuit located within the made-shot-detecting electronics module 112 quickly and easily from the exterior of the made-shot-detecting electronics module 112.

In general, the inventive system works by applying a constant DC voltage across the length of the strand of conductive material 114 and measuring the voltage drop across the strand 114, which voltage drop will vary in accordance with changing resistance of the strand 114 as the strand 114 is stretched. Typically, as noted above, resistance of the strand 114 will increase as the strand 114 stretches, so the voltage drop across the strand will also increase. In other words, the voltage value at the output end of the strand 114, relative to ground, will decrease. By filtering out a steady-state component of a system output voltage, voltage change due to a change in resistance as the strand 114 stretches—e.g., in particular, when a basketball passes through the net 108—can be identified.

Figure 2:
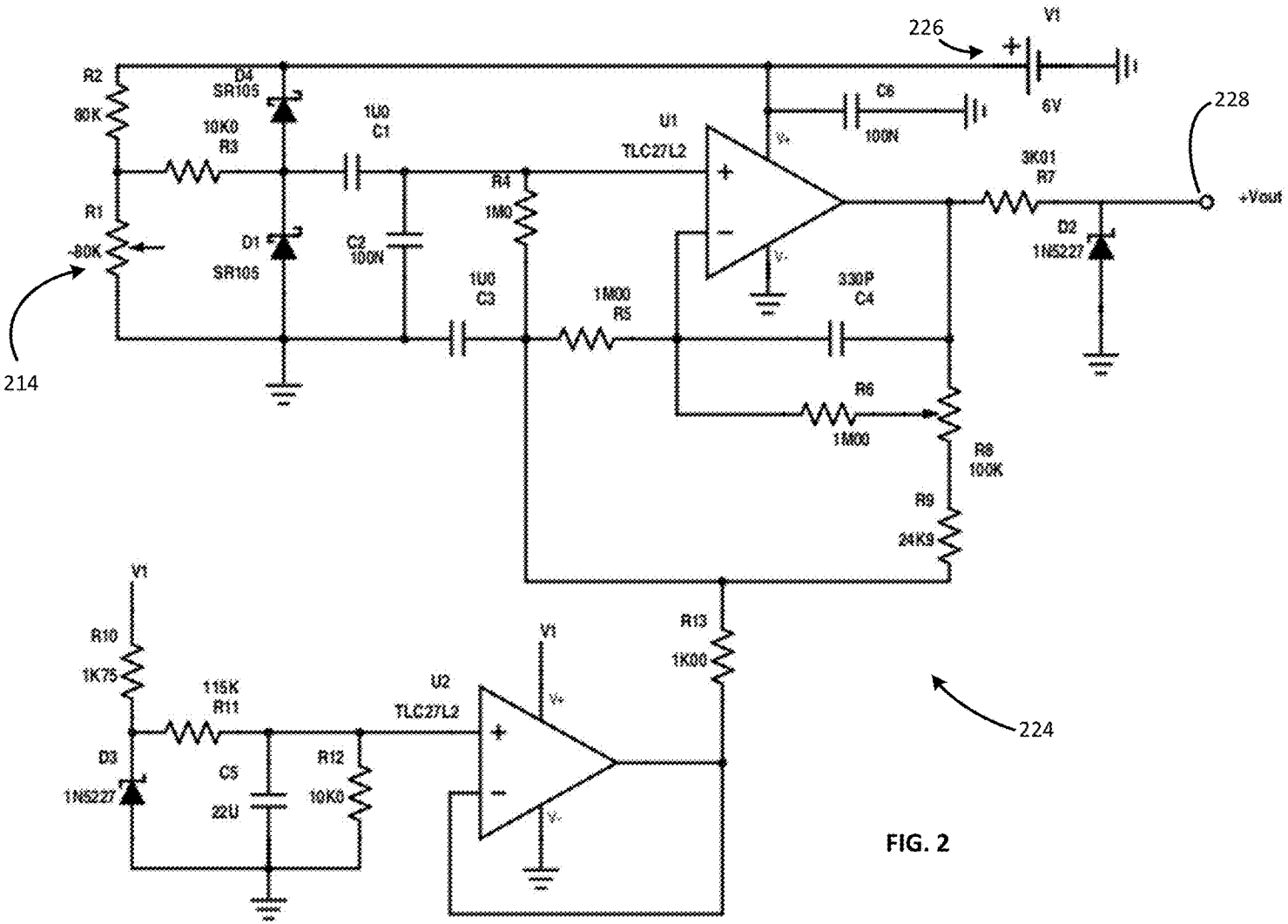
FIG. 2 is a schematic diagram of a sensing circuit used in connection with the made-shot-detecting net illustrated in FIG. 1.

A sensing circuit 224 to accomplish this steady-state-component-filtering is illustrated in FIG. 2, where the net—more specifically, the strand of conductive material 214 extending through the net—is represented as a variable resistor RI with a nominal resistance value of approximately 80 KΩ. (The actual value will depend on the length of the strand of conductive material 214.) An input voltage, e.g. 6 volts, is supplied, for example, by battery 226, and a system output voltage value is measured at node 228. A potentiometer R8 (i.e., a variable-resistance device) with a nominal resistance of 100 KΩ is provided to "trim" the output of the sensing circuit 224. Other components of the sensing circuit 224 and their exemplary values are illustrated in FIG. 2.

Because steady-state components are filtered out of the voltage signal "coming off of" the net by the sensing circuit 224, thereby yielding a signal indicative of shape-changing motion of the net, the output of the circuit as measured at the output node 228 will have a relatively constant, steady-state value while the net is simply hanging still in an equilibrium state. (The actual value may drift slightly and slowly over time, e.g., if the strand 214 is not perfectly elastic and does not return to its original length, but because the system is configured to respond to changing voltage values as explained more fully below, such drift is acceptable.) On the other hand, when the net 108 is disturbed and the strand of conductive material 214 is stretched in some fashion, the output of the circuit 224 will vary rapidly in a discernible and relatively uniform manner when a basketball passes through the net.

Figure 3:
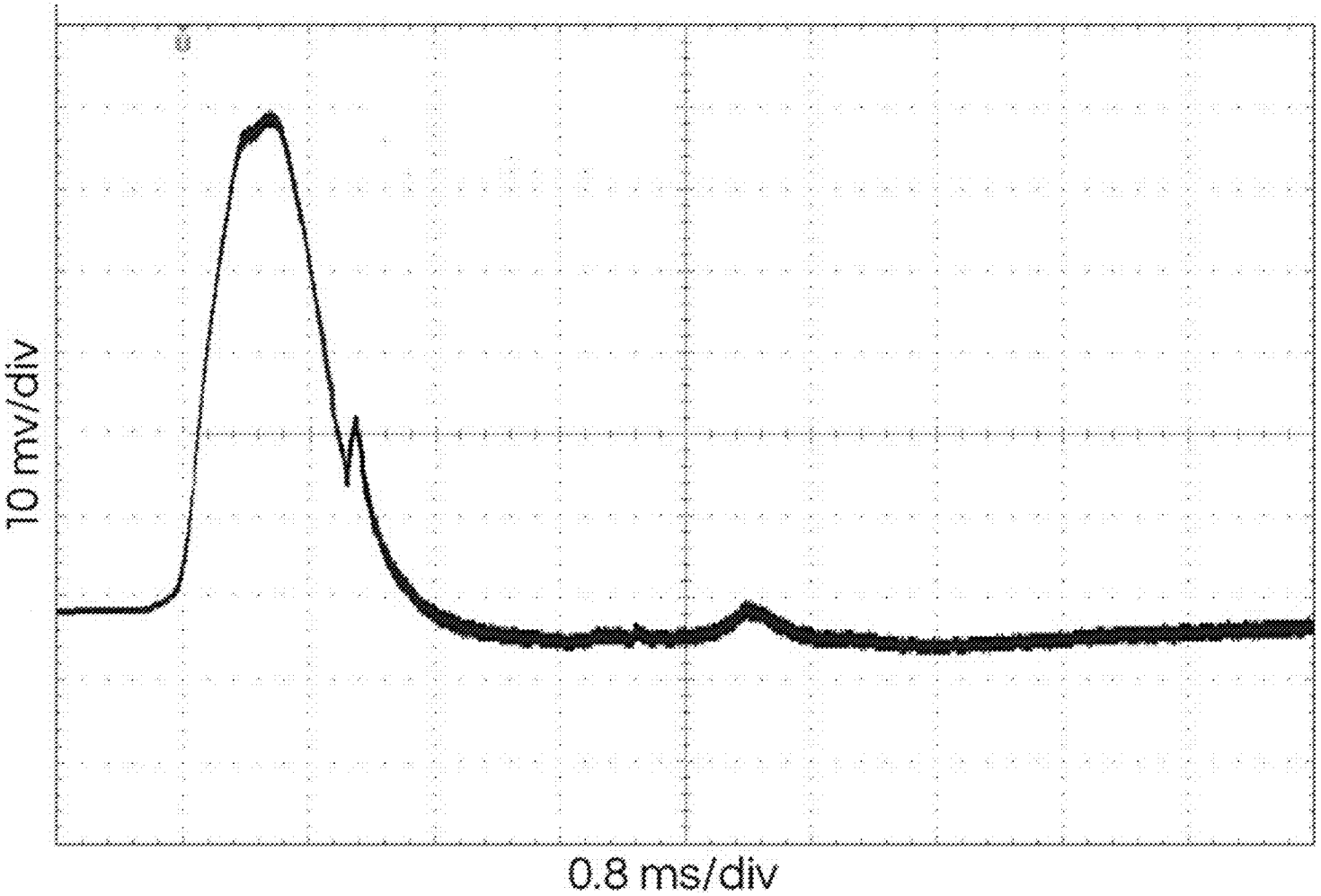
FIGS. 3-5 are graphs illustrating the output over time of the sensing circuit of FIG. 2 when a basketball passes through the net; when the ball simply "grazes" the net without passing through it; and when the ball bounces off of the rim without passing though the net, respectively.
Figure 4:
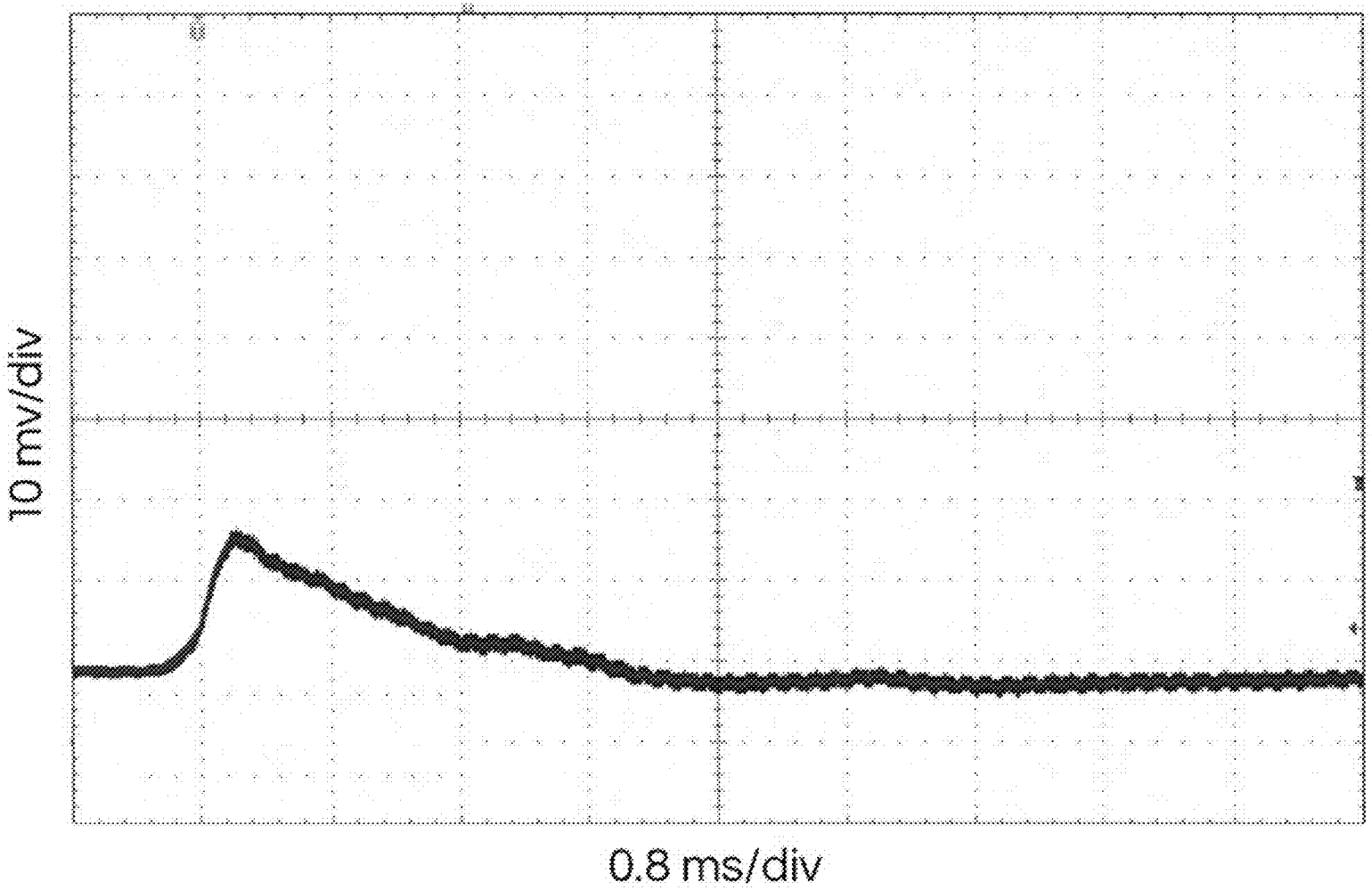
Figure 5:
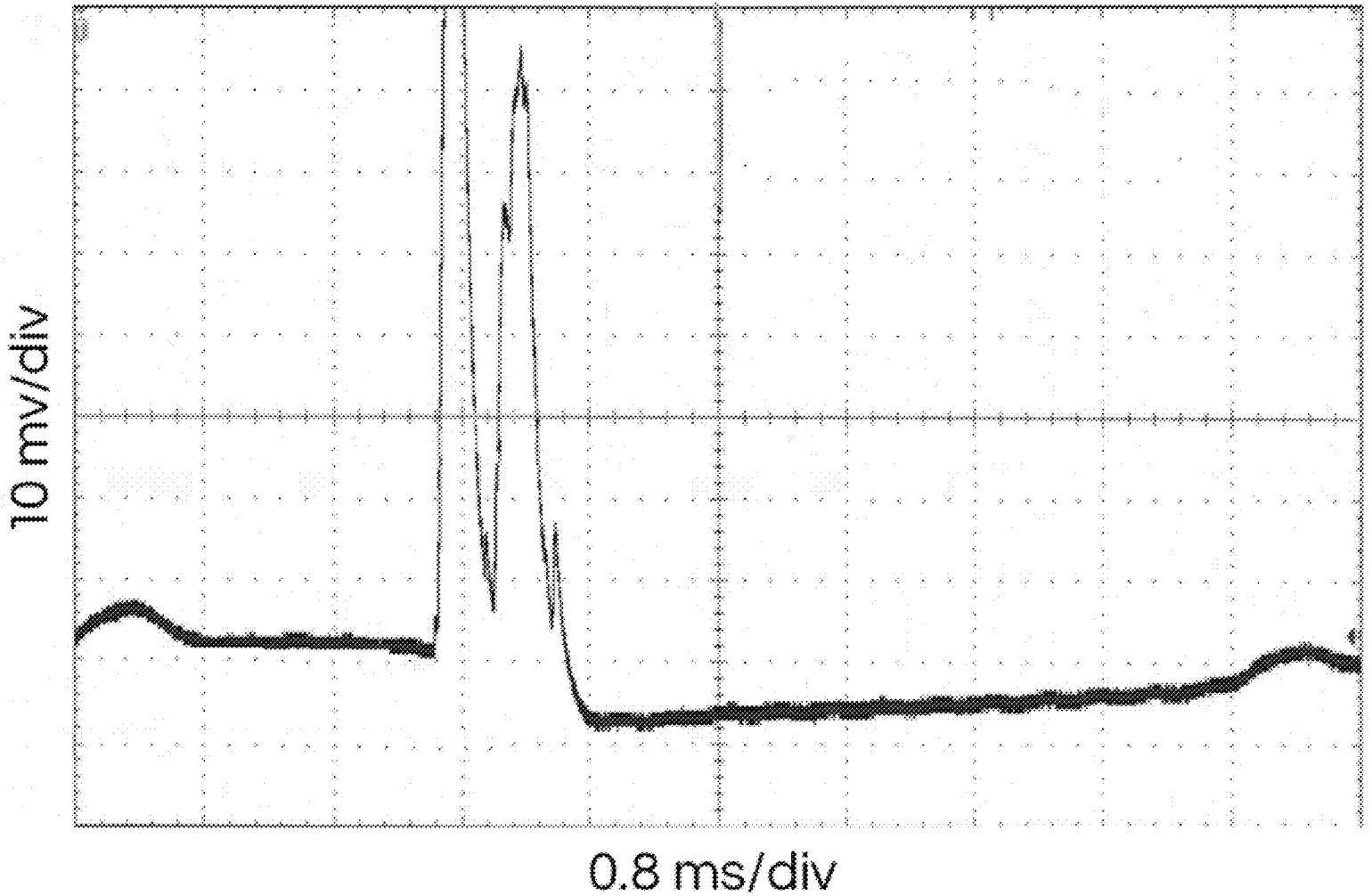

Thus, as illustrated in FIG. 3 for a successful shot, the output of the sensing circuit 224 will rise relatively quickly and smoothly and then return to a value at or near the preceding steady-state value as a basketball passes through the net 108, which causes maximal sustained stretching/elongation of the strand of conductive material 114. (In the embodiment of the net 108 illustrated in FIG. 1, the strand of conductive material 104 has both longitudinal (i.e., vertical) and circumferential components due to it zigzagging back and forth through the eyelets 110; this configuration results in greater total stretch of the strand of conductive material 114 and therefore greater signal variation, which provides a reliable mechanism to detect a shot that has been made successfully.) On the other hand, if the ball simply grazes the net, stretching and elongation of the strand of conductive material 114 will be significantly less, thereby resulting in a considerably smaller degree of variation in the output of the sensing circuit 224 as illustrated in FIG. 4. And if the ball bounces off of the rim and does not pass through the net, the output of the sensing circuit 224 will be highly erratic, as illustrated in FIG. 5. In this case, the sharp rise in the sensing-circuit output represents a quick and relatively violent stretch of the conductive material as the comparatively stiff metal hoop first moves in one direction as it is deflected by the basketball, and then quickly moves in the opposite direction to recover from its initial deflection. The small width and sharp spike of the circuit output is attributable to the fast response of the metal hoop and the very small displacement of the strand of conductive material as compared to the displacement typically caused when a basketball passes through the net, thereby stretching the net over a longer period of time.

Notably, the area under each respective sensing-circuit output curve shown in FIGS. 3-5 is fairly distinct from the area under the curve shown in each of the other two figures, and the value of the area is fairly uniform from shot to shot to shot of a given type (i.e., shot made, net-grazing shot, and bounced shot). Thus, by digitally integrating the sensing-circuit output in response to a suitable triggering event—e.g. the sensing-circuit output departing from a steady-state condition—so as to effectively measure the area under the sensing-circuit output curve, and then comparing the measured value of the area to certain pre-established thresholds, the different types of shot events—successful shot, grazing shot, rim bounce, or even just bouncing off the backboard—can be identified.

As noted above, a made-shot-detecting net configured to operate in accordance with the invention may be used as part of an overall shot-tracking system, in which shot-attempts can be identified by monitoring a player's wrist motion and shots made are detected by monitoring the net. Alternatively, the made-shot-detecting net could be used by itself, i.e., without specifically identifying shot-attempts, simply to count the number of shots that are made. For either case, however, the interrelationship of the net and computational components of the system is illustrated in FIGS. 6-8.

Figure 6:
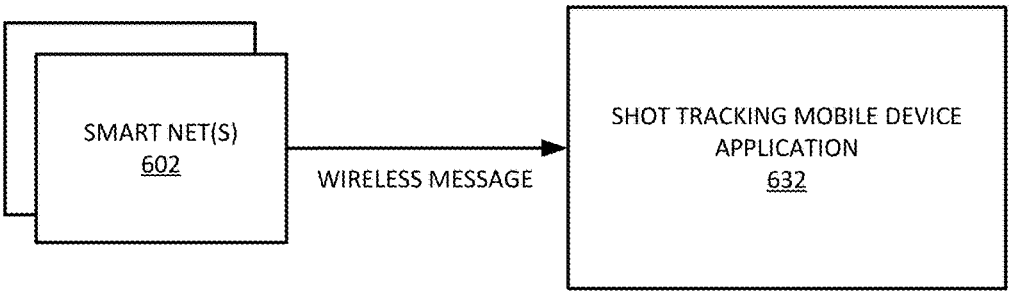
FIG. 6 is a schematic diagram illustrating the interaction of a made-shot-detecting net and a shot-tracking program being executed on a mobile computing device in accordance with an embodiment of the claimed invention.
Figure 7:
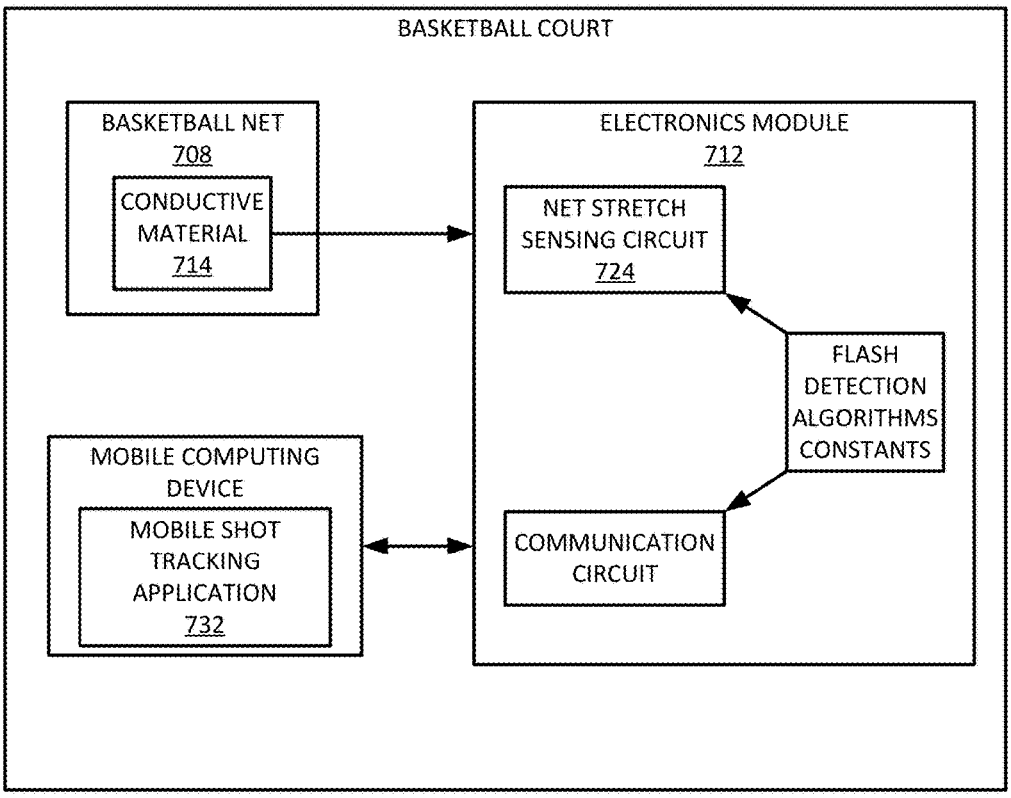
FIG. 7 is a schematic diagram illustrating one embodiment of a made-shot-detecting net system configured to operate in accordance with the claimed invention, which system includes a made-shot-detecting net, a made-shot-detecting electronics module, and a mobile computing device.

Thus, as shown in FIG. 6, one or more hoop assemblies 602—each including a made-shot-detecting net and made-shot-detecting electronics module as described above—may be deployed around a given basketball court. All of the hoop assemblies 602 communicate wirelessly with a mobile computing device, which runs a suitable shot-tracking application 632. As indicated schematically in FIG. 7, the strand of conductive material 714 that is integrated into the net 708 is in electrical communication with the made-shot-detecting electronics module 712 and, in particular, the sensing circuit 724 as described above.

Figure 8:
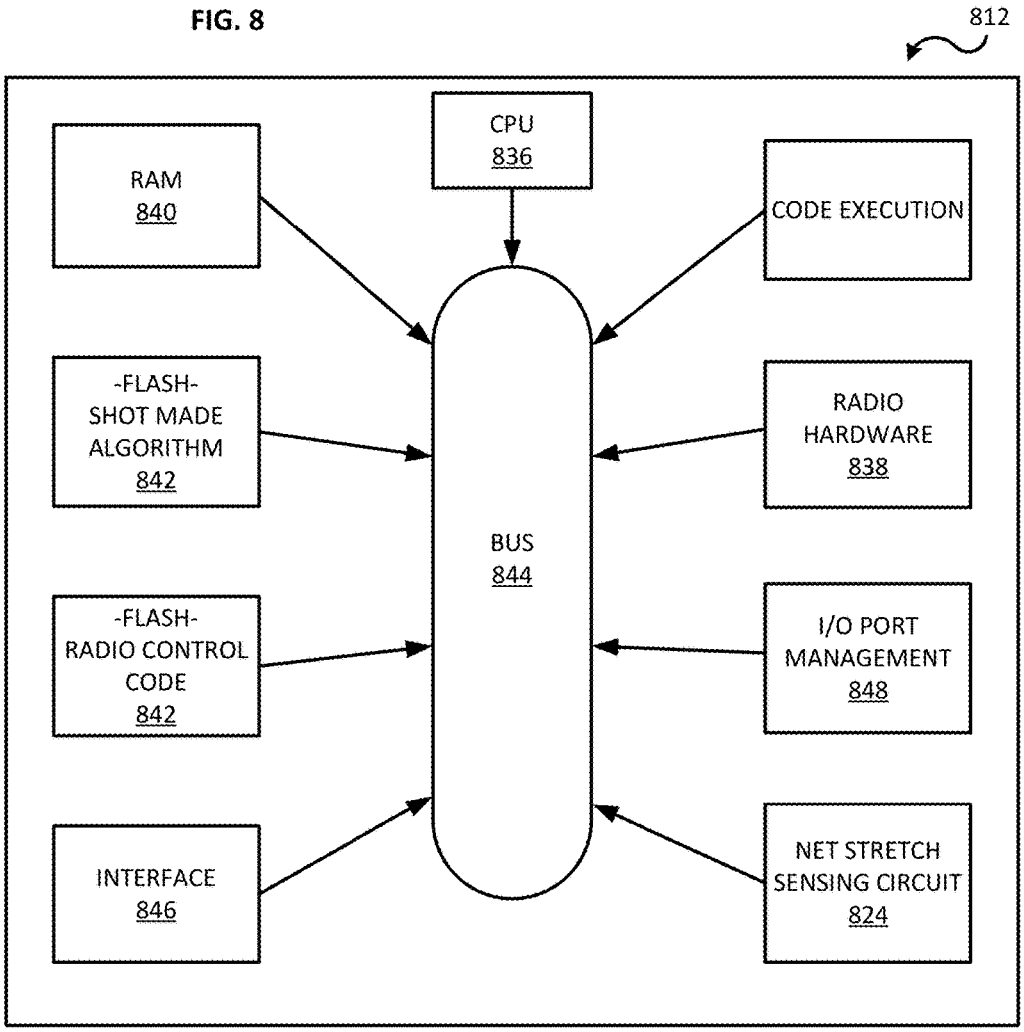
FIG. 8 is a schematic diagram illustrating the relationship between various components within the made-shot-detecting electronics module.

As shown in FIG. 8, the made-shot-detecting electronics module 812 includes a circuit board (not identified specifically) with a number of components mounted to it. These components include a microprocessor or CPU 836; the sensing circuit 824; a wireless antenna 838, e.g., an antenna configured to operate according to Bluetooth®) transmission protocols; RAM 840, which is utilized during execution of the made-shot-detecting algorithm (addressed below); long-term non-volatile FLASH memory 842, which contains programming code configured to execute the shot-detection algorithms and to control the wireless communication, as well as predetermined threshold values and other parameters (addressed below); and bus 844, by means of which the various components communicate with each other. The interface 846 connects all of the various external components to the circuit board, and the I/O port management is software that manages communication over the ports as well as communication over the BUS 844.

Figure 9:
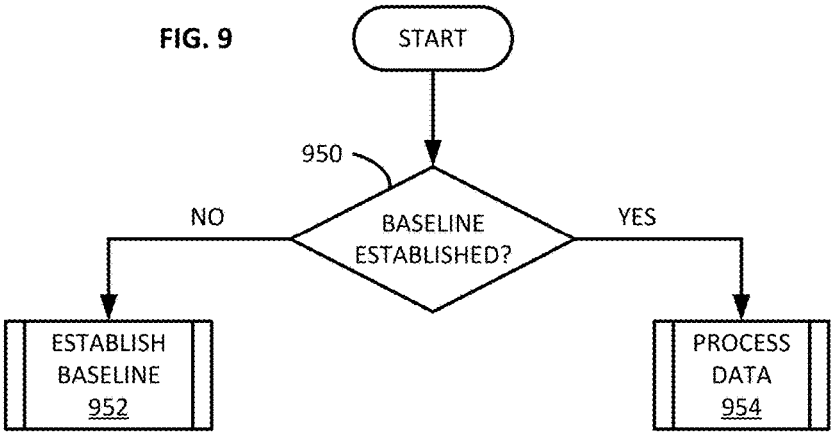
FIG. 9 is a high-level flowchart illustrating overall operation of a made-shot-detecting program that runs on the made-shot-detecting electronics module.
Figure 10:
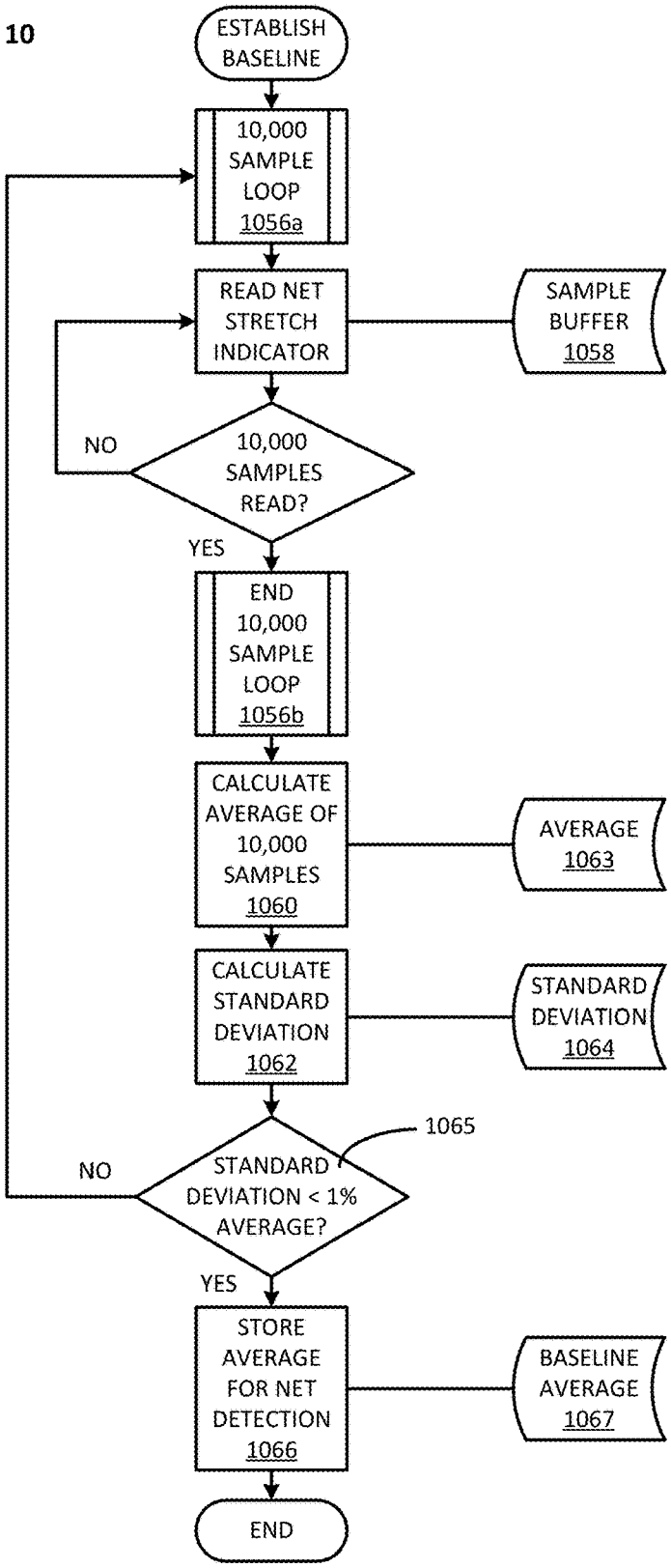
FIG. 10 is a flowchart illustrating how the made-shot-detecting program establishes a steady-state baseline configuration.
Figure 11:
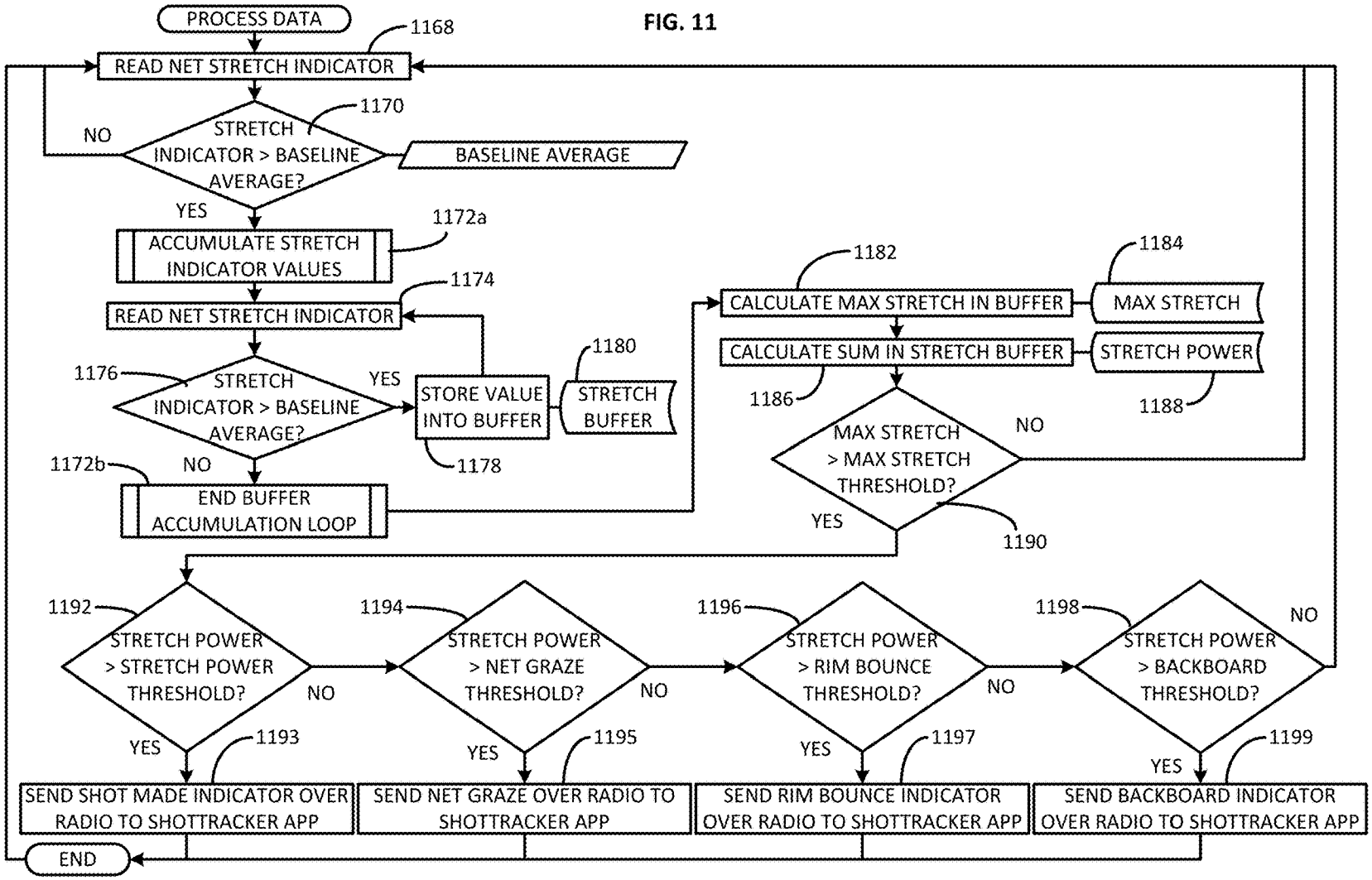
FIG. 11 is a flowchart illustrating how the made-shot-detecting program identifies shots that have been made (as well as certain other events at the net).

Regarding operation of the system's software (i.e., the various algorithms implemented on the system's microprocessor by the software), it is illustrated at a very high level in FIG. 9, and in greater detail in FIGS. 10 and 11. In particular, as illustrated in FIG. 9, once the system has been turned on and initialized, it first determines whether a steady-state baseline condition of the net has been established (step 950). If a steady-state baseline condition has not been established, the software implements an algorithm to do so (step 952), which is illustrated in greater detail in FIG. 10. Otherwise, the software implements an active, shot-detecting algorithm (step 954), which is illustrated in greater detail in FIG. 11.

As shown in FIG. 10, the system first establishes a steady-state baseline corresponding to the net not moving by executing a one-second loop with starting point 1056*a* and ending point 1056*b*, during which loop suitably 10,000 values of the sensing circuit output voltage are read and saved in buffer memory 1058. (The system is suitably configured to read the output of the sensing circuit at a rate of 10,000 samples per second.) Once 10,000 values have been read and saved, the system calculates the average value of the samples (step 1060) and the standard deviation of the 10,000 samples (step 1062) and saves these two values in memory (steps 1063 and 1064, respectively).

At step 1065, the system determines whether the standard deviation of the 10,000 data points is less than 1% of the average value of the 10,000 data points. If it is, then the net is not moving and the system stores the average value of the data points into memory (at steps 1066, 1067) as a baseline value of the sensing circuit output and the process moves to the active, shot-detecting algorithm (i.e., step 1054 in FIG. 9). Otherwise, the system returns to the loop with end points 1056*a* and 1056*b* to repeat the process with another set of 10,000 data points until the net-not-moving, steady-state condition (standard deviation is less than 1% of the average value) is established. Suitably, to hasten the process of establishing a baseline value of the sensing circuit output voltage, the system "moves forward" by 10,000 data points, i.e. one second worth of data, each time it repeats the loop. This is in contrast to a "moving-window" approach, in which the window of time over which the 10,000 samples is taken would move forward by only one or two sample increments at a time.

The active, shot-detecting processing algorithm is illustrated in FIG. 11. At step 1168, the system reads an individual value of the sensing circuit output voltage and, at step 1170, compares it to the baseline average that was stored in memory at steps 1066 and 1067 of the algorithm shown in FIG. 10 and described above. If the value of the sensing circuit output voltage is not greater than the baseline average, then the net is not moving, and the program returns to step 1168 and reads the next value of the sensing circuit output voltage.

On the other hand, once the value of the sensing circuit output voltage rises above the baseline average value, which indicates the net is being stretched, the program enters the loop having starting point 1172*a* and 1172*b*, over the course of which data is accumulated to be analyzed for various types of net events. In particular, at step 1174, the sensing circuit output voltage is again read and compared to the baseline average value at step 1176. Each time the sensing circuit output voltage exceeds the baseline average value, the instantaneous value is stored in the memory buffer (step 1178, 1180) and the process loops back to step 1174 to read the next sequential value of the sensing circuit output. On the other hand, once the sensing circuit output voltage has dropped back down to the baseline average value (result of step 1176 determination is "no"), the loop 1172*a*/1172*b* terminates and subsequent processing is conducted. Comparing the sensing circuit output voltage to the baseline average value within the loop, at step 1176, which is duplicative of the comparison made at step 1170, is necessary in order to exit the loop once it has been initiated.

After the program exits the loop 1172*a*/1172, it determines the maximum value of the sensing circuit output voltage (step 1182) and stores this value in memory (1184). The program may use a simple subroutine, not illustrated specifically, to identify this maximum value of the sensing circuit output voltage. Additionally, the program digitally integrates the sensing circuit output voltage over the period of time corresponding to a net perturbation—i.e., it determines the area under the trace of the sensing-circuit output voltage over time, as illustrated in FIGS. 3-5 for three different types of net perturbation—by summing the amount by which the sensing circuit output voltage exceeds the baseline average value (step 1186). The program then stores the sum in memory as a "stretch power" value (1188).

At step 1190 (which could be implemented before the sensing circuit output voltage is summed at step 1186 if desired), the maximum value of the sensing circuit output voltage is compared to an empirically determined threshold value, e.g., 15 millivolts. (This threshold value and those addressed below are all based on a 6-volt input into the sensing circuit 224; a strand of conductive material having a nominal resistance of 80 kΩ; and there being no amplification of the sensing-circuit output.) If the maximum value of the sensing circuit output voltage does not exceed the threshold value, the net perturbation was minor and clearly does not reflect a ball passing through the net. In that case, the program returns to step 1168 to begin the active, shot-detecting process once again. On the other hand, if the maximum value of the sensing circuit output voltage does exceed the threshold value, the stretch power value (1188) is compared against various other empirically determined threshold values (steps 1192, 1194, 1196, and 1198) to characterize the net perturbation event that has occurred.

Thus, if the stretch power value exceeds a first stretch power threshold value, e.g., 1.2 millivolt-seconds (step 1192), the program concludes that a successful shot has been made—i.e., the ball has passed through the net—and causes a shot-made indicator to be sent wirelessly to the shot-tracking program running on the mobile computing device (step 1193), which shot-tracking program tabulates successful shots that have been made (preferably with the successful shots being tracked according to type of shot that has been made successfully). The program then returns to the start of the active, shot-detecting process.

On the other hand, if the stretch power value does not exceed the stretch power threshold value, but it does exceed a "secondary," net-graze threshold value, e.g., 0.45 millivolt-seconds (step 1194), the program concludes that the ball has simply grazed the net, and therefore causes a net-grazed indicator to be sent wirelessly to the shot-tracking program running on the mobile computing device (step 1195). The program then returns to the start of the active, shot-detecting process.

Furthermore, if the stretch power value does not exceed the net-graze power threshold value, but it does exceed another "secondary," rim-bounce threshold value, e.g., 0.10 millivolt-seconds (step 1196), then the program concludes that the ball has simply bounced off the rim and causes a rim-bounce indicator to be sent wirelessly to the shot-tracking program running on the mobile computing device (step 1197). The program then returns to the start of the active, shot-detecting process.

Still further, if the stretch power value does not exceed the rim-bounce power threshold value, but it does exceed yet another "secondary," backboard-strike threshold value, e.g., 0.01 millivolt-seconds (step 1198), then the program concludes that the ball has simply struck the backboard and bounced off, and it causes a backboard-strike indicator to be sent wirelessly to the shot-tracking program running on the mobile computing device (step 1199). The program then returns to the start of the active, shot-detecting process.

The foregoing disclosure is only intended to be exemplary of the methods and products of the present invention. Departures from and modifications to the disclosed embodiments may occur to those having skill in the art. The scope of the invention is set forth in the following claims.

We claim:

1. A made-shot-detecting net system configured to detect when a basketball shot is made successfully, the net system comprising:

a net with a circumferential direction and a longitudinal direction and upper and lower openings through which a basketball can pass when a basketball shot is made successfully, the configuration of the net being such that the net stretches in at least one direction when a basketball passes through it;

a strand of elastomeric conductive material extending along a portion of the net in a manner to stretch with the net when the net stretches as a basketball passes through it, the strand of elastomeric conductive material having an electrical property that varies as the elastomeric conductive material stretches; and a made-shot-detecting electronics module to which the strand of elastomeric conductive material is connected or is configured to be connected, the made-shot-detecting electronics module including a sensing circuit a) that makes electrical contact with the strand of conductive material when the strand of conductive material is connected to the made-shot-detecting electronics module, and b) an electrical output of which varies over time as the electrical property of the strand of elastomeric conductive material varies;

the made-shot-detecting electronics module further including a processor and computer program code configured to cause the processor to read a series of values over time of the sensing circuit's electrical output and to compare the series of values over time to a normative profile over time of the sensing circuit's electrical output over time that corresponds to a basketball passing through the net and to determine whether a basketball has passed through the net.

2. The net system of claim 1, wherein comparing the series of values over time of the sensing circuit's electrical output to the normative profile comprises digitally integrating the series of values over time to determine a stretch power value and comparing the stretch power value to a first, predetermined threshold value that is associated with the normative profile.

3. The net system of claim 2, wherein the computer program code is configured to cause the processor to determine a steady-state baseline value of the sensing circuit's electrical output corresponding to a condition in which the net is not moving.

4. The net system of claim 3, wherein digitally integrating the series of values over time of the sensing circuit's electrical output comprises summing a difference between the value of the sensing circuit's electrical output and the steady-state baseline value.

5. The net system of claim 3, wherein the computer program code is configured such that the series of values over time of the sensing circuit's electrical output are only integrated for periods of time during which the sensing circuit's electrical output exceeds the baseline value.

6. The net system of claim 5, wherein the made-shot-detecting electronics module further includes a wireless transmitter and the computer program code is configured to cause a message to be sent, via the wireless transmitter, indicating that a basketball shot has been made successfully if the stretch power value satisfies a predetermined relationship relative to the first, predetermined threshold value.

7. The net system of claim 6, wherein the computer program code is configured to cause the processor to compare the stretch power value to one or more secondary threshold values associated with net events other than a successful shot being made in the event the stretch power value does not satisfy the predetermined relationship relative to the first, predetermined threshold value.

8. The net system of claim 1, wherein the electrical property is resistance.

9. The net system of claim 1, wherein the sensing circuit's electrical output is a voltage.

10. The net system of claim 1, wherein the strand of elastomeric conductive material extends in a circumferential direction around the net.

11. The net system of claim 10, wherein the strand of elastomeric conductive material extends at least essentially completely around the net.

12. The net system of claim 11, wherein the strand of elastomeric conductive material extends around an upper portion of the net and forms loops by means of which the net can be attached to a basketball hoop.

13. A system for tracking basketball-shooting performance, comprising:

a made-shot-detecting net system configured to detect when a basketball shot is made successfully, the net system comprising a net with a circumferential direction and a longitudinal direction and upper and lower openings through which a basketball can pass when a basketball shot is made successfully, the configuration of the net being such that the net stretches in at least one direction when a basketball passes through it;

a strand of elastomeric conductive material extending along a portion of the net in a manner to stretch with the net when the net stretches as a basketball passes through it, the strand of elastomeric conductive material having an electrical property that varies over time as the elastomeric conductive material stretches; and a made-shot-detecting electronics module to which the strand of elastomeric conductive material is connected or is configured to be connected, the made-shot-detecting electronics module including 1) a sensing circuit a) that makes electrical contact with the strand of conductive material when the strand of conductive material is connected to the made-shot-detecting electronics module, and b) an electrical output of which varies as the electrical property of the strand of elastomeric conductive material varies; and 2) a wireless transmitter;

the made-shot-detecting electronics module further including a processor and computer program code configured 1) to cause the processor to read a series of values over time of the sensing circuit's electrical output and to compare the series of values over time to a normative profile over time of the sensing circuit's electrical output over time that corresponds to a basketball passing through the net and to determine whether a basketball has passed through the net; and 2) to cause a message to be sent, via the wireless transmitter, indicating that a basketball shot has been made successfully upon the processor determining that a basketball has passed through the net; and a mobile computing device having a shot-tracking computer program thereon, the shot-tracking computer program being configured to receive the message sent from the made-shot-detecting electronics module and to tabulate successfully made shots.

14. The tracking system of claim 13, wherein comparing the series of values over time of the sensing circuit's electrical output to the normative profile comprises digitally integrating the series of values over time to determine a stretch power value and comparing the stretch power value to a first, predetermined threshold value that is associated with the normative profile.

15. The tracking system of claim 14, wherein the computer program code is configured to cause the processor to compare the stretch power value to one or more secondary threshold values associated with net events other than a successful shot being made in the event the stretch power value does not satisfy the predetermined relationship relative to the first, predetermined threshold value, and to cause a message to be sent to the shot-tracking computer program, via the wireless transmitter, indicating the type of non-successful-shot net event that has occurred upon a determination thereof.

16. The tracking system of claim 12, wherein the electrical property is resistance.

17. The tracking system of claim 12, wherein the sensing circuit's electrical output is a voltage.

* * * * *